US009358594B2

(12) United States Patent
Nikkuni et al.

(10) Patent No.: US 9,358,594 B2
(45) Date of Patent: Jun. 7, 2016

(54) MANUFACTURING APPARATUS AND MANUFACTURING METHOD OF HOT-ROLLED STEEL SHEET

(71) Applicants: Daisuke Nikkuni, Osaka (JP); Suguhiro Fukushima, Osaka (JP); Takao Owada, Hiroshima (JP); Toshihiro Usugi, Hiroshima (JP)

(72) Inventors: Daisuke Nikkuni, Osaka (JP); Suguhiro Fukushima, Osaka (JP); Takao Owada, Hiroshima (JP); Toshihiro Usugi, Hiroshima (JP)

(73) Assignees: NIPPON STEEL & SUMITOMO METAL CORPORATION, Tokyo (JP); PRIMETALS TECHNOLOGIES JAPAN, LTD., Tokyo (JP)

( * ) Notice: Subject to any disclaimer, the term of this patent is extended or adjusted under 35 U.S.C. 154(b) by 0 days.

(21) Appl. No.: 13/625,096

(22) Filed: Sep. 24, 2012

(65) Prior Publication Data

US 2013/0014553 A1 Jan. 17, 2013

Related U.S. Application Data

(63) Continuation of application No. PCT/JP2011/057877, filed on Mar. 29, 2011.

(30) Foreign Application Priority Data

Mar. 31, 2010 (JP) ..... 2010-083532

(51) Int. Cl.
*B21B 28/04* (2006.01)
*B21B 27/10* (2006.01)
(Continued)

(52) U.S. Cl.
CPC ..... *B21B 28/04* (2013.01); *B21B 27/10* (2013.01); *B21B 38/006* (2013.01); *B21B 45/0284* (2013.01); *B21B 2261/20* (2013.01); *B21B 2265/12* (2013.01)

(58) Field of Classification Search
CPC .. B21B 27/06; B21B 27/10; B21B 2027/103; B21B 37/32; B21B 38/006; B21B 2261/20; B21B 2261/21; B21B 37/74; B21B 1/26; B21B 45/08; B21B 28/04; B21C 43/04; B21C 23/32; B21C 9/00; B24B 1/00; B24B 5/04; B24B 5/045; B24B 49/14
USPC ..... 72/8.5, 11.3, 12.2, 39–41, 43, 201, 236; 451/5, 7, 8, 49, 53, 54, 55, 65, 67, 68
See application file for complete search history.

(56) References Cited

U.S. PATENT DOCUMENTS 2,234,153 A * 3/1941 Herbert ..... 72/39
4,575,972 A * 3/1986 Ohki et al. ..... 451/424
(Continued)

FOREIGN PATENT DOCUMENTS

DE 102 02 189 7/2003
JP 60-244405 12/1985
(Continued)

*Primary Examiner* — David Bryant
*Assistant Examiner* — Lawrence Averick
(74) *Attorney, Agent, or Firm* — Clark & Brody

(57) ABSTRACT

Provided is a manufacturing apparatus and manufacturing method of hot-rolled steel sheet which enables uniform cooling of a rolled material and improvement of the surface properties thereof. The manufacturing apparatus comprises: a rolling stand; a supplying device capable of supplying lubricant to work rolls and/or backup rolls; an online roll grinding device; and a removing device capable of removing at least part of the lubricant before the surface of the work rolls is ground by the grinding device. The manufacturing method comprises the steps of: removing at least part of the lubricant adhered to the work rolls, or to the work rolls and backup rolls using the lubricant removing device after completing rolling of a preceding material; grinding the work rolls using the online roll grinding device after the removing step; and supplying the lubricant to the work rolls and/or backup rolls from the lubricant supplying device.

10 Claims, 5 Drawing Sheets

(51) Int. Cl.
*B21B 45/02* (2006.01)
*B21B 38/00* (2006.01)

(56) References Cited

U.S. PATENT DOCUMENTS 5,657,655 A * 8/1997 Yasuda et al. ..... 72/11.5
5,768,927 A * 6/1998 Kajiwara et al. ..... 72/10.1
5,789,066 A * 8/1998 De Mare et al. ..... 428/156
5,970,771 A * 10/1999 Ginzburg ..... 72/247
6,076,388 A * 6/2000 Kajiwara et al. ..... 72/236
7,076,983 B2 * 7/2006 Chikushi et al. ..... 72/201
2002/0100307 A1 * 8/2002 Narita et al. ..... 72/236
2007/0210104 A1 * 9/2007 Buenten et al. ..... 222/144.5

FOREIGN PATENT DOCUMENTS

JP 09-164408 6/1997
JP 11-319916 11/1999
JP 2001-259715 9/2001
JP 2002-178011 6/2002
JP 2003-285114 10/2003
JP 2004-314080 11/2004

* cited by examiner

3/5

MANUFACTURING APPARATUS AND MANUFACTURING METHOD OF HOT-ROLLED STEEL SHEET

TECHNICAL FIELD

The present invention relates to a manufacturing apparatus and a manufacturing method of a hot-rolled steel sheet. It particularly relates to a manufacturing apparatus and a manufacturing method of a hot-rolled steel sheet focusing on inhibiting surface roughness of a rolling roll in a finishing mill and taking measures against surface roughness thereof.

BACKGROUND ART

When high load rolling causing a line load of 1.0 t/mm or more, especially a line load of 2.0 t/mm or more is carried out in one of the latter-stage stands in a row of finishing mills disposed in a manufacturing line of a hot-rolled steel sheet, a surface of a rolling roll tends to be rough due to increased surface pressure of the rolling roll. This surface roughness affects coolability and surface properties of a rolled material; therefore, in order to cool the rolled material uniformly in the entire width direction thereof and manufacture a hot-rolled steel sheet having excellent surface properties, some measures need to be taken to inhibit and resolve the surface roughness of the rolling roll.

It is known to use a lubricant as a means to inhibit the surface roughness, and it is known to perform online roll grinding as a means to resolve the surface roughness. Using the lubricant enables reduction of a rolling load and thereby reduction of a surface pressure of the rolling roll. Therefore, the surface roughness can be inhibited. However, in the high load rolling, it is difficult to fully reduce the rolling load only with the lubricant; and if the high load rolling using the lubricant is carried out for a long period of time, inhibition of the surface roughness is likely to be insufficient. On the other hand, if online roll grinding is carried out, it is possible to make the surface of the rolling roll a smooth curved face by grinding the roughened surface of the rolling roll. However, since there is a large wear amount of the rolling roll in the high load rolling, simply carrying out the online roll grinding is likely to lead to such problems as increase in the costs of the rolling roll due to increase in the grinding amount thereof, and degradation of the productivity due to long grinding time.

Therefore, in order to uniformly cool a rolled material when the high load rolling is carried out and to manufacture a hot-rolled steel sheet having excellent surface properties, it is necessary to employ both a lubricant and online roll grinding. However, if a large amount of lubricant remains on a work roll surface, grinding unevenness occurs during grinding by an online roll grinding device. When there is grinding unevenness, it is difficult to grind the work roll into a target roll roughness, and therefore it is likely to be difficult to uniformly cool a material rolled in the high load rolling, and to improve the surface properties of the rolled material.

As a technique related to such a hot rolling line, Patent Document 1 for example discloses a roll lubrication method in which to supply a rolling lubricant to work rolls during hot rolling, wherein a rolling oil mixed with water by an oil-water mixing device is sprayed at the work rolls, while the work rolls are ground by an online roll grinding device. Further, Patent Document 2 discloses a hot rolling method in which to start applying a rolling lubricant oil to work rolls after a front end portion of a material to be rolled is fed through the work rolls; carryout lubrication rolling until rolling of a back end portion of the material to be rolled is completed; and remove the rolling lubricant oil adhered to the work rolls at the time of rolling the preceding material to be rolled, during the time between completion of the rolling of the preceding material to be rolled and entry of a following material to be rolled through the work rolls.

CITATION LIST

Patent Literature

Patent Document 1: Japanese Patent Application Laid-Open (JP-A) No. 11-319916
Patent Document 2: JP-A No. 2002-178011

SUMMARY OF INVENTION

Problems to be Solved by the Invention

In the technique disclosed in Patent Document 1, however, the rolling oil (lubricant) mixed with water is supplied to the work rolls while they are ground by the online roll grinding device; therefore, grinding unevenness tends to occur during grinding by the online roll grinding device. As such, with the technique disclosed in Patent Document 1, it is difficult to grind work rolls into a required roll roughness, and thus it is likely to be difficult to uniformly cool a material rolled in high load rolling and to improve the surface properties of the rolled material. Additionally, in the technique disclosed in Patent Document 2, the work rolls are not ground by an online roll grinding device; therefore, the surface of the work rolls tends to be rough, likely causing difficulty in uniformly cooling a material rolled in high load rolling and in improving the surface properties of the rolled material.

Accordingly, the present invention provides a manufacturing apparatus and a manufacturing method of a hot-rolled steel sheet by which a rolled material can be cooled uniformly and the surface properties of the rolled material can be improved.

Means for Solving the Problems

As a result of their intensive studies, the inventors have discovered that: it is effective to carry out online roll grinding between a preceding material to be rolled and a following material to be rolled that are continuously rolled (hereinafter referred to as "between bars") in order to control a work roll surface; however, when a large amount of lubricant remains on the work roll surface, grinding unevenness occurs during grinding by an online roll grinding device and thus it is difficult to grind the work roll into a target roll roughness Ra. Therefore, it is seen that in order to grind the work roll into a target roll roughness Ra, it is effective to remove the lubricant in advance before carrying out the online roll grinding. In this case, a method in which supply of a lubricant is stopped in the tail end portion of the preceding material to be rolled and the lubricant adhered to the roll is burned off causes a problem that when the width of the following material to be rolled is larger than that of the preceding material to be rolled, the lubricant is likely to remain on the work roll surface which contacts both end portions of the following material to be rolled in the sheet width direction, or other areas, and thus it tends to be difficult to fully remove the lubricant. There is also a problem that in removing, by grinding, unevenness between a part of the work roll where a hot-rolled steel sheet passes and a part where it does not pass, grinding unevenness occurs due to the lubricant remaining on the part where the hot-rolled steel sheet does not pass and thus it is difficult to grind the work roll into a required roll profile. Accordingly, it is considered preferable to remove the lubricant by spraying hot water or the like at a work roll, or at a work roll and a backup roll.

On the other hand, as a result of their intensive studies, the inventors have found that: there is a correlation between the roll roughness Ra of a work roll surface and the temperature unevenness of the cooled material in the sheet width direction generated at a time of cooling the rolled material after rolling; and in order to cool the rolled material uniformly in the entire sheet width direction thereof, the roll roughness Ra needs to be at a certain value or less (for example, Ra≤0.8 μm). On the other hand, they have found that if the roll roughness Ra is too small, the feeding performance of the front end portion of the material to be cooled degrades, and thus the roll roughness Ra needs to be at a predetermined value or more (for example, 0.05 μm≤Ra). The present invention has been completed based on these findings.

The present invention will be described below. Although the reference numerals given in the accompanying drawings are shown in parentheses to make the present invention easy to understand, the invention is not limited to the embodiments shown in the drawings.

A first aspect of the present invention is a manufacturing apparatus (10, 20) of a hot-rolled steel sheet comprising: a rolling stand (1) provided with work rolls (1*a*, 1*a*) and backup rolls (1*b*, 1*b*); a lubricant supplying device (2, 2) capable of supplying a lubricant to the work rolls and/or the backup rolls; an online roll grinding device (3, 3) capable of grinding a surface of the work rolls; and a lubricant removing device (4, 4, capable of removing at least a part of the lubricant adhered to the work rolls, or to the work rolls and the backup rolls, before the surface of the work rolls is ground by the online roll grinding device.

In the first aspect of the present invention and a below described second aspect of the present invention, the "lubricant supplying device (2, 2) capable of supplying a lubricant to the work rolls and/or the backup rolls" means that the lubricant supplying device (2, 2) is capable of supplying a lubricant to the work rolls or the backup rolls, or to the work rolls and the backup rolls.

Further, in the above first aspect of the present invention, two or more rolling stands (1, 1, . . . ) are preferably disposed continuously in a traveling direction of a material (5) to be rolled by the rolling stands; and a cooling device (6) which cools the rolled material is preferably disposed on a downstream side, in the traveling direction, of the rolling stand disposed on an end on the downstream side in the traveling direction.

Furthermore, in the above first aspect of the present invention, a line load is preferably 1.0 t/mm or more at least in the rolling stand (1) disposed on the end on the downstream side in the traveling direction at a time when the material (5) to be rolled is rolled by this rolling stand.

Moreover, in the above first aspect of the present invention, a detecting device (7) capable of detecting temperature unevenness of the material (5) rolled by the rolling stand is disposed on a downstream side of the cooling device (6) in the traveling direction; and a control device (8) is provided which is capable of controlling operation of the online roll grinding device (3, 3) based on the temperature unevenness detected by the detecting device; thereby the advantageous effects of the present invention can be notably exerted.

Here, in the present invention, the expression that "a detecting device (7) capable of detecting temperature unevenness of the material (5) rolled by the rolling stand is disposed on a downstream side of the cooling device (6) in the traveling direction" indicates a configuration that the detecting device (7) is disposed on a downstream side of the cooling device in the traveling direction, and the detecting device (7) is preferably disposed on the downstream side of the cooling device (6) and an upstream side of a run-out table. Further, the detecting device (7) may be disposed only on an upper surface side of the material (5) to be rolled or only on a lower surface side thereof; or it may be disposed on both the upper and lower surface sides of the material (5) to be rolled.

A second aspect of the present invention is a manufacturing method of a hot-rolled steel sheet in which to roll a plurality of materials (5, 5, . . . ) to be rolled by using a manufacturing apparatus (10, 20) of a hot-rolled steel sheet that comprises: a rolling stand (1) provided with work rolls (1*a*, 1*a*) and backup rolls (1*b*, 1*b*); a lubricant supplying device (2, 2) capable of supplying a lubricant to the work rolls and/or the backup rolls; an online roll grinding device (3, 3) capable of grinding a surface of the work rolls; and a lubricant removing device (4, 4, . . . ) capable of removing at least a part of the lubricant adhered to the work rolls, or to the work rolls and the backup rolls, before the surface of the work rolls is ground by the online roll grinding device, the method comprising: a removing step (S1) of removing at least a part of the lubricant adhered to the work rolls, or to the work rolls and the backup rolls by using the lubricant removing device after completing rolling of a preceding material (5) to be rolled; a grinding step (S2) of grinding the work rolls by using the online roll grinding device after the removing step; a feeding step (S3) of feeding a front end portion of a following material (5) to be rolled through the work rolls after the grinding step; a supplying step (S4) of supplying the lubricant to the work rolls and/or the backup rolls from the lubricant supplying device after the feeding step; a stopping step (S5) of stopping supply of the lubricant from the lubricant supplying device after the supplying step; and a judging step (S6) of judging, after the stopping step, whether or not there remains the material that needs to be rolled.

Further, in the above second aspect of the present invention, two or more rolling stands (1, 1, . . . ) are preferably disposed continuously in a traveling direction of a material (5) to be rolled by the rolling stands; a cooling device (6) which cools the rolled material is preferably disposed on a downstream side, in the traveling direction, of the rolling stand (1) disposed on an end on the downstream side in the traveling direction; and the rolled material is preferably cooled by the cooling device immediately after completion of the rolling by the rolling stand disposed on the end on the downstream side in the traveling direction.

Herein, the expression that "the rolled material is cooled by the cooling device immediately after completion of the rolling by the rolling stand disposed on the end on the downstream side in the traveling direction" means cooling the rolled material by using the cooling device at a cooling rate of 600° C./s or more within 0.2 seconds after completion of the rolling by the rolling stand disposed on the end on the downstream side in the traveling direction.

Furthermore, in the above second aspect of the present invention, a line load is preferably 1.0 t/mm or more at least in the rolling stand (1) disposed on the end on the downstream side in the traveling direction at a time when the material (5) to be rolled is rolled by this rolling stand.

Moreover, in the above second aspect of the present invention, a detecting device (7) capable of detecting temperature unevenness of the material (5) rolled by the rolling stand is disposed on a downstream side of the rolling stand (1) in the traveling direction; and a control device (8) is provided which is capable of controlling operation of the online roll grinding device (3, 3) based on the temperature unevenness detected by the detecting device; thereby the advantageous effects of the present invention can be notably exerted.

Effects of the Invention

In the first aspect of the present invention, the lubricant removing device (4, 4, . . . ) is provided which is capable of removing at least a part of a lubricant adhered to the work rolls (1*a*, 1*a*), or to the work rolls and the backup rolls (1*b*, 1*b*) before the surface of the work rolls (1*a*, 1*a*) is ground by the online roll grinding device (3, 3). Therefore, it is possible to grind the work roll surface into a target roll roughness Ra by using the online roll grinding device, and to inhibit roughness of the work roll surface by using the lubricant. As such, according to the first aspect of the present invention, it is possible to provide a manufacturing apparatus (10, 20) of a hot-rolled steel sheet which enables uniform cooling of a rolled material and improvement of the surface properties of the rolled material.

Further, in the first aspect of the present invention, the cooling device (6) is disposed on the more downstream side in the traveling direction of the material (5) to be rolled than the rolling stand (1) disposed on the end on the downstream side in the traveling direction of the material (5) to be rolled. Thereby, it is possible to provide a manufacturing apparatus of a hot-rolled steel sheet which enables uniform cooling of a hot-rolled steel sheet having fine crystal grains with an average particle size of for example about 2 μm or less (hereinafter simply referred to as "fine crystal grains"), and enables improvement of the surface properties of the hot-rolled steel sheet having fine crystal grains. Further, the line load is 1.0 t/mm or more at least in the rolling stand (1) disposed on the end on the downstream side in the traveling direction, and thereby it is possible to easily manufacture a hot-rolled steel sheet having fine crystal grains with reduced surface roughness (with improved surface properties). Furthermore, with the control device (8) capable of controlling operation of the online roll grinding device (3, 3) based on the temperature unevenness detected by the detecting device (7), it is possible to easily cool a rolled material uniformly and improve the surface properties of the rolled material.

The second aspect of the present invention comprises: the removing step (S1) of removing at least a part of a lubricant adhered to the work rolls (1*a*, 1*a*), or to the work rolls and the backup rolls (1*b*, 1*b*) by using the lubricant removing device (4, 4), after completing rolling of the preceding material (5) to be rolled; the grinding step (S2) of grinding the work rolls by using the online roll grinding device (3, 3) after the removing step; and the supplying step (S4) of supplying a lubricant to the work rolls from the lubricant supplying device (2, 2) after the feeding step (S3). Therefore, it is possible to grind the work roll surface into a target roll roughness Ra by using the online roll grinding device, and to inhibit roughness of the work roll surface by using the lubricant. As such, according to the second aspect of the present invention, it is possible to provide a manufacturing method of a hot-rolled steel sheet which enables uniform cooling of a rolled material and improvement of the surface properties of the rolled material.

Further in the second aspect of the present invention, the cooling device (6) is disposed on the more downstream side in the traveling direction of the material (5) to be rolled than the rolling stand (1) disposed on the end on the downstream side in the traveling direction of the material (5) to be rolled. Thereby, it is possible to provide a manufacturing method of a hot-rolled steel sheet which enables uniform cooling of a hot-rolled steel sheet having fine crystal grains, and enables improvement of the surface properties of the hot-rolled steel sheet having fine crystal grains. Further, the line load is 1.0 t/mm or more at least in the rolling stand (1) disposed on the end on the downstream side in the traveling direction, and thereby it is possible to easily manufacture a hot-rolled steel sheet having fine crystal grains with reduced surface roughness (with improved surface properties). Furthermore, with the control device (8) capable of controlling operation of the online roll grinding device (3, 3) based on the temperature unevenness detected by the detecting device (7), it is possible to easily cool a rolled material uniformly and improve the surface properties of the rolled material.

MODES FOR CARRYING OUT THE INVENTION

Figure 1:
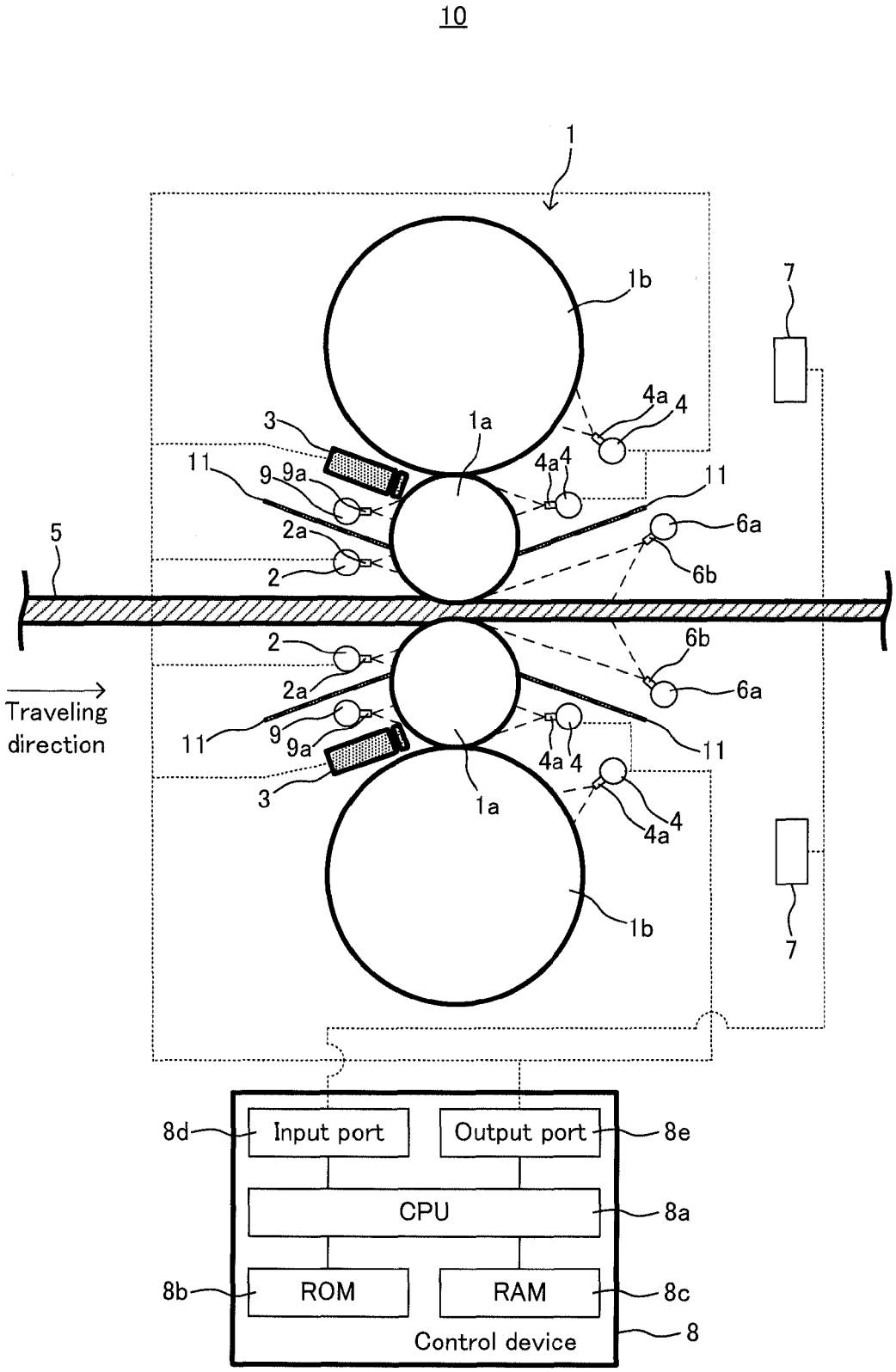
FIG. 1 is a simplified view of a part of a manufacturing apparatus 10 of a hot-rolled steel sheet of the present invention.

Hereinafter, the mode for carrying out the present invention will be described with reference to the drawings. It should be noted that the below embodiment shown in the drawings is an example of the present invention and that the present invention is not limited to this. In the below descriptions, the downstream side in the traveling direction of the material to be rolled is simply written as a "downstream side".

Figure 2:
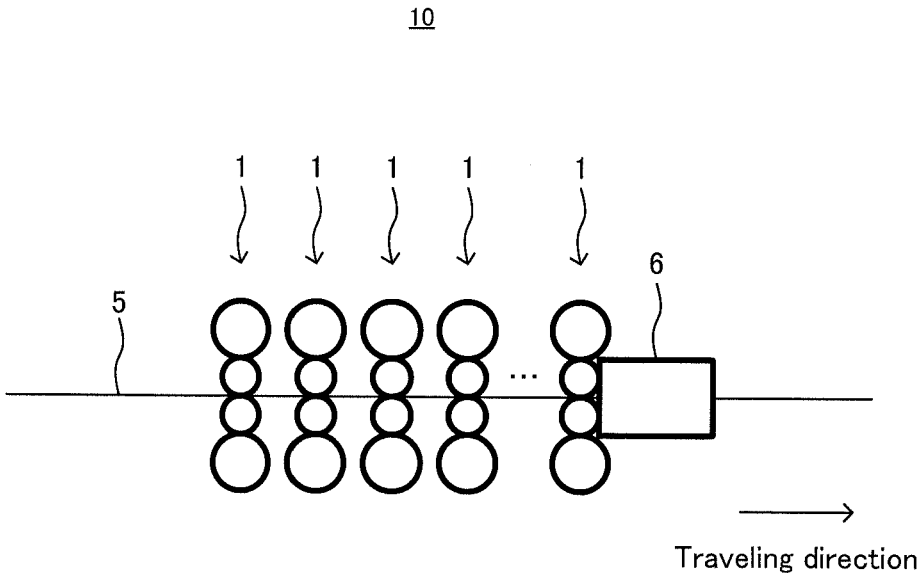
FIG. 2 is a simplified view of a configuration example of the manufacturing apparatus 10 of a hot-rolled steel sheet of the present invention.

FIG. 1 is a simplified view of a part of a manufacturing apparatus 10 of a hot-rolled steel sheet of the present invention (hereinafter sometimes simply referred to as a "manufacturing apparatus 10"). FIG. 1 shows: among a plurality of finishing stands 1, 1, . . . provided to the manufacturing apparatus 10, the finishing stand 1 disposed on the end on the downstream side (hereinafter referred to as a "final finishing stand 1"); devices accompanying this final finishing stand 1; and a part of a cooling device 6 disposed on the downstream side of this final finishing stand 1. FIG. 2 is a simplified view of a configuration example of the manufacturing apparatus 10 of a hot-rolled steel sheet of the present invention. FIG. 2 shows: the finishing stands 1, 1, . . . , disposed continuously; the cooling device 6 disposed on the downstream side of the final finishing stand 1 in a manner adjacent thereto; and a material 5 to be rolled. FIG. 2 does not show a roughing mill disposed on an upstream side of the finishing stand 1 in the traveling direction of the material 5 to be rolled, a coiling device disposed on a downstream side of the cooling device 6, and other components. In FIGS. 1 and 2, the material 5 to be rolled travels from the left side to the right side of the drawing sheets. As shown in FIG. 1, the finishing stand 1 provided to the manufacturing apparatus 10 comprises work rolls 1*a*, 1*a*, and backup rolls 1*b*, 1*b*; and as shown in FIG. 2, the manufacturing apparatus 10 comprises a plurality of finishing stands 1, 1, . . . . The manufacturing apparatus 10 further comprises: headers 2, 2 of a lubricant supplying device capable of supplying a lubricant to the work rolls 1*a*, 1*a*; an online roll grinding device 3, 3 capable of grinding a surface of the work rolls 1*a*, 1*a*; headers 4, 4 of a lubricant removing device; headers 6*a*, 6*a* of the cooling device 6 capable of cooling the material 5 rolled by the finishing stand 1; a temperature sensor 7 capable of detecting the temperature of the rolled material 5; a control device 8 capable of controlling operation of the online roll grinding device 3, 3; headers 9, 9 of a water-cooling device which cools the work rolls 1*a*, 1*a* with water; and water draining plates 11, 11 which drain water sprayed from the headers 9, 9. The nozzles 2*a*, 2*a* are connected to the headers 2, 2; the nozzles 4*a*, 4*a* are connected to the headers 4, 4; the nozzles 6*b*, 6*b* are connected to the headers 6*a*, 6*a*; and the nozzles 9*a*, 9*a* are connected to the headers 9, 9.

The control device 8 controls operations of the lubricant removing device provided with the headers 4, 4, the online roll grinding device 3, 3, and so on, based on the result of the temperature of the rolled material 5 detected by the temperature sensor 7. The control device 8 is provided with: a CPU 8*a* which performs operation control of the lubricant removing device, the online roll grinding device 3, 3, and so on; and a memory device corresponding to the CPU 8*a*. The CPU 8*a* is constituted by a combination of a micro processor unit and various peripheral circuits necessary for operation thereof. The memory device corresponding to the CPU 8*a* is constituted by combining ROM 8*b* which stores a program and various data necessary for the operational control of the lubricant removing device, the online roll grinding device 3, 3, etc., with RAM 8*c* which functions as a work area of the CPU 8*a*, and so on. In addition to this constitution, the CPU 8*a* is combined with a software stored in the ROM 8*b*. Thereby, the control device 8 in the manufacturing apparatus 10 works. The information (an output signal) on the temperature of the rolled material 5 detected by the temperature sensor 7 reaches the CPU 8*a* as an input signal, via an input port 8*d* of the control device 8. The CPU 8*a* controls, via an output port 8*e*, an operation command given to the lubricant removing device, the online roll grinding device 3, 3, and so on, based on the input signal and the program stored in the ROM 8*b*. The online roll grinding device 3, 3 is operated when the temperature unevenness of the rolled material 5 calculated by using the temperature of the rolled material 5 detected by the temperature sensor 7 is at a predetermined value or more.

In the manufacturing apparatus 10, the operation of the online roll grinding device 3, 3 is controlled by the control device 8 so as to reduce the temperature unevenness of the rolled material 5 calculated by using the result of the temperature of the rolled material 5 detected by the temperature sensor 7. In a case when grinding of the work rolls 1*a*, 1*a* is performed by the online roll grinding device 3, 3, which operates based on the operation command given by the control device 8, the operation of the lubricant removing device is controlled by the control device 8 before the grinding of the work rolls, in a way that hot water having a temperature of 50° C. or more is sprayed from the nozzles 4*a*, 4*a* toward the work rolls 1*a*, 1*a* and the backup rolls 1*b*, 1*b*. Then the lubricant adhered onto the surface of the work rolls 1*a*, 1*a* and the backup rolls 1*b*, 1*b* is removed by the hot water sprayed from the lubricant removing device. Once the hot water is sprayed from the lubricant removing device, an operation command will be outputted from the control device 8 to the online roll grinding device 3, 3; and the surface of the work rolls 1*a*, 1*a* will be ground by the online roll grinding device 3, 3, thereby controlling a roll roughness Ra of the work rolls 1*a*, 1*a* to a target value.

In the manufacturing apparatus 10, the lubricant on the surface of the work rolls 1*a*, 1*a* is removed by the lubricant removing device before the surface of the work rolls 1*a*, 1*a* is ground by the online roll grinding device 3, 3. Therefore, it is possible to reduce occurrence of the grinding unevenness by the online roll grinding device 3, 3 and to control the roll roughness Ra of the work rolls 1*a*, 1*a* to a target value. In the manufacturing apparatus 10, once the roll roughness Ra is controlled to be a target value in this manner, rolling of a following material 5 to be rolled will be started using the finishing stand 1. In rolling the following material 5 to be rolled, a lubricant starts to be supplied to the work rolls 1*a*, 1*a* from the lubricant supplying device comprising the headers 2, 2, after a front end portion of the following material 5 to be rolled is fed through the work rolls 1*a*, 1*a* having a controlled roll roughness Ra. Then a constant portion (in which the front end portion and the tail end portion are not included) of the following material 5 to be rolled is rolled by using the work rolls 1*a*, 1*a* supplied with the lubricant. Once the constant portion of the following material 5 to be rolled is rolled in this manner, an operation command will be outputted from the control device 8 to the lubricant supplying device, stopping supply of the lubricant, and rolling of the following material 5 to be rolled will be completed. In this way, in the manufacturing apparatus 10, the lubricant is used to roll the material 5 to be rolled. Therefore, surface roughness of the work rolls 1*a*, 1*a* can be inhibited.

Further, in the manufacturing apparatus 10, the cooling device 6 is disposed on the downstream side of the finishing stand 1 in a manner adjacent thereto. In the manufacturing apparatus 10, for example high load rolling is carried out in which a line load is 2.0 t/mm or more in the three downstream-side finishing stands 1, 1, 1 among the finishing stands 1, 1, . . . ; and thereafter the rolled material 5 is rapidly cooled at a cooling rate of 600° C./s or more (preferably 1000° C./s or more) within 0.2 seconds after completion of rolling by the final finishing stand 1. Thereby, it is possible to manufacture a hot-rolled steel sheet (ultrafine-grained steel) having an average particle size of ferrite crystal grains at 2 μm or less with improved surface properties; and improving the surface properties of such ultrafine-grained steel enables uniform cooling and reduction of unevenness of the mechanical properties of the steel sheet in the sheet width direction in the secondary processing thereof.

Figure 3:
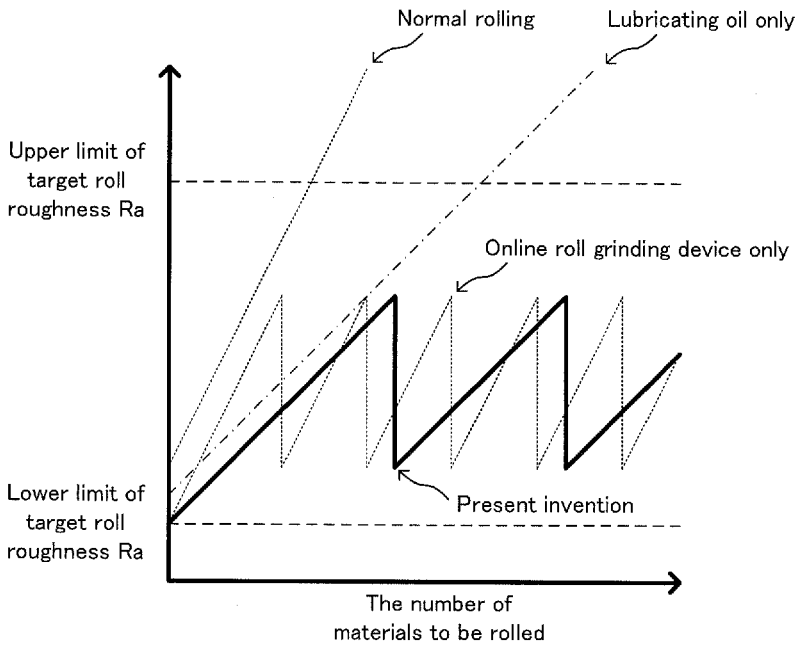
FIG. 3 is a conceptual view illustrating a relation between the number of materials to be rolled and the roll roughness Ra.

FIG. 3 is a conceptual view illustrating a relation between the number of the materials to be rolled and the roll roughness Ra of the work roll 1*a*. As shown in FIG. 3, in ordinary rolling in which neither the lubricant nor the online roll grinding device is used, the roll roughness Ra increases dramatically as the number of materials to be rolled increases. On the other hand, if a lubricant is used during rolling, it is possible to inhibit increase in the roll roughness Ra better than in the case of ordinary rolling. However, when the number of materials to be rolled exceeds a certain value, the roll roughness Ra exceeds an upper limit of a target range. On the other hand, if rolling is carried out using the work rolls that have been ground by the online roll grinding device, it is possible to control the roll roughness Ra to be in the target range. However, in order to control the roll roughness Ra to be in the target range, the work rolls need to be ground frequently. By contrast, according to the manufacturing apparatus 10 which rolls a material to be rolled by using a lubricant and removes the lubricant before carrying out grinding by the online roll grinding device, it is possible to control the roll roughness Ra to be in a target range even while reducing the number of times of grinding by the online roll grinding device. Accordingly, with the manufacturing apparatus 10, the productivity of the hot-rolled steel sheet can also be improved.

In the above descriptions of the manufacturing apparatus of a hot-rolled steel sheet of the present invention (hereinafter sometimes referred to as a "manufacturing apparatus of the present invention"), the manufacturing apparatus 10 comprising the lubricant supplying device which supplies a lubricant to the work rolls 1*a*, 1*a* has been introduced as an example. However, the manufacturing apparatus of the present invention is not limited to this configuration. The lubricant supplying device provided to the manufacturing apparatus of the present invention may be configured to be capable of supplying a lubricant only to the backup rolls; or it may be configured to be capable of supplying a lubricant to both the work rolls and the backup rolls. Accordingly, FIG. 4 partially shows a manufacturing apparatus 20 of a hot-rolled steel sheet of the present invention (hereinafter sometimes referred to as a "manufacturing apparatus 20"), which comprises a lubricant supplying device to supply a lubricant to the backup rolls 1*b*, 1*b*, in addition to the configuration of the manufacturing apparatus 10.

Figure 4:
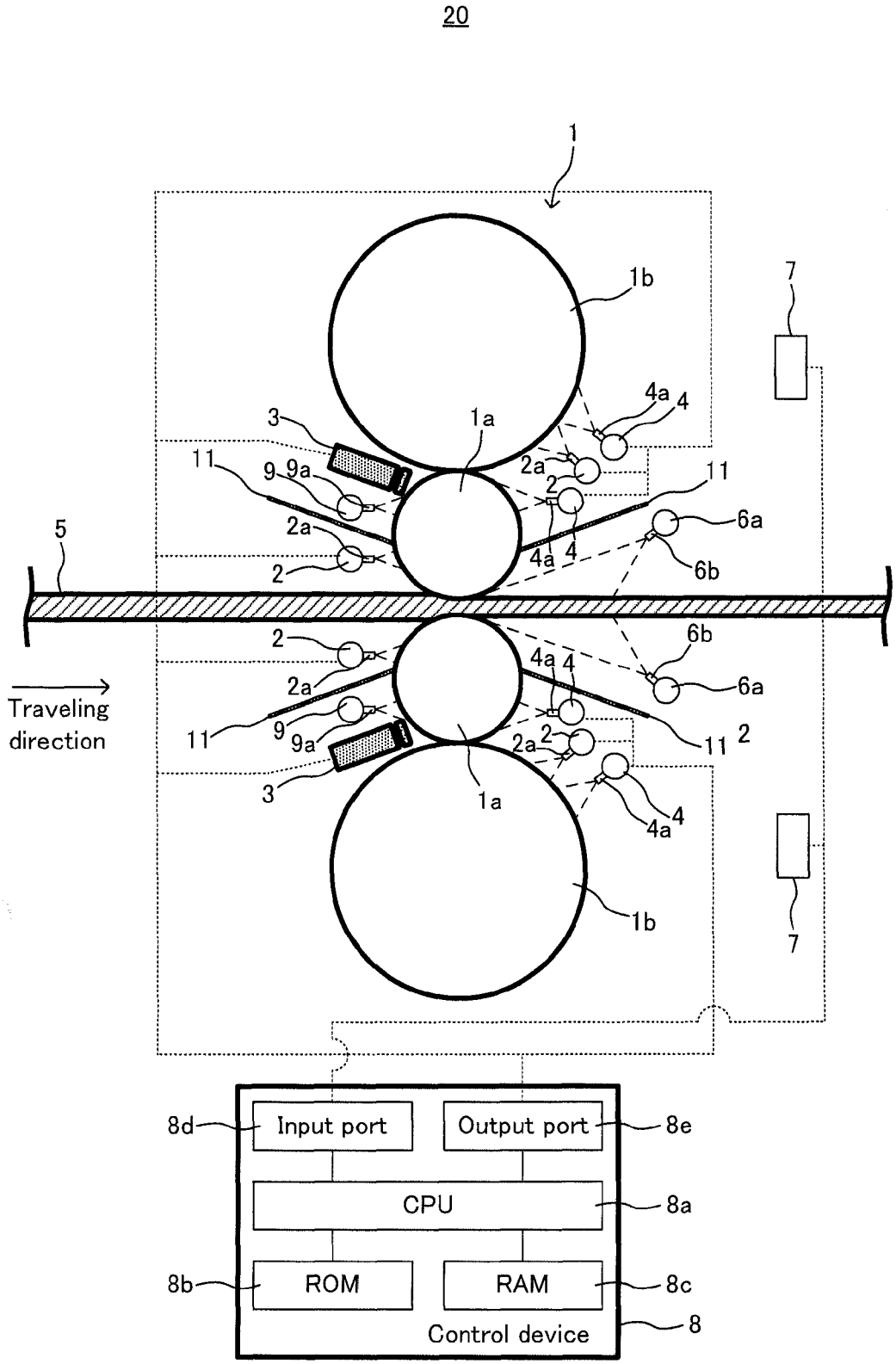
FIG. 4 is a simplified view of a part of a manufacturing apparatus 20 of a hot-rolled steel sheet of the present invention.

FIG. 4 is a simplified view of a part of the manufacturing apparatus 20. FIG. 4 corresponds to FIG. 1. The manufacturing apparatus 20 is configured in the same manner as the manufacturing apparatus 10 except that it additionally comprises the lubricant supplying device capable of supplying a lubricant to the backup rolls 1*b*, 1*b*. In FIG. 4, the same numerals as shown in FIGS. 1 and 2 are given to the same constituents as those of the manufacturing apparatus 10; and descriptions of these same constituents will be omitted if appropriate.

As shown in FIG. 4, the manufacturing apparatus 20 comprises a lubricant supplying device capable of supplying a lubricant to the backup rolls 1*b*, 1*b*, in addition to the configuration of the manufacturing apparatus 10. The lubricant is supplied to the backup rolls 1*b*, 1*b* via the headers 2, 2 and the nozzles 2*a*, 2*a* connected thereto of the lubricant supplying device. In the manufacturing apparatus 20, the lubricant on the surface of the work rolls 1*a*, 1*a* and the backup rolls 1*b*, 1*b* is removed by the lubricant removing device before the surface of the work rolls 1*a*, 1*a* is ground by the online roll grinding device 3, 3. Therefore, it is possible to reduce occurrence of the grinding unevenness by the online roll grinding device 3, 3 and to control the roll roughness Ra of the work rolls 1*a*, 1*a* to a target value. In the manufacturing apparatus 20, once the roll roughness Ra is controlled to be a target value in this way, rolling of a following material 5 to be rolled will be started using the finishing stand 1. In rolling the following material to be rolled, after a front end portion of the following material 5 to be rolled is fed through the work rolls 1*a*, 1*a* having a controlled roll roughness Ra, a lubricant starts to be supplied to the work rolls 1*a*, 1*a* or the backup rolls 1*b*, 1*b*, or to the work rolls 1*a*, 1*a* and the backup rolls 1*b*, 1*b* from the lubricant supplying device comprising the headers 2, 2, the operation of which is controlled by the control device 8. Then a constant portion (in which the front end portion and the tail end portion are not included) of the following material 5 to be rolled is rolled by using the work rolls 1*a*, 1*a* supplied with the lubricant. Once the constant portion of the following material 5 to be rolled is rolled in this manner, an operation command will be outputted from the control device 8 to the lubricant supplying device, stopping supply of the lubricant, and rolling of the following material 5 to be rolled will be completed. In this way, in the manufacturing apparatus 20 the lubricant is used to roll the material 5 to be rolled. Therefore, surface roughness of the work rolls 1*a*, 1*a* can be inhibited. As shown in FIG. 4, the work roll 1*a* which contacts one face of the material 5 to be rolled is in contact with the backup roll 1*b*; and the work roll 1*a* which contacts the other face of the material 5 to be rolled is also in contact with the backup roll 1*b*. Therefore, even if a lubricant is supplied only to the backup rolls 1*b*, 1*b* from the lubricant supplying device provided with the headers 2, 2, . . . , the lubricant is supplied to the work rolls 1*a*, 1*a* via the backup rolls 1*b*, 1*b*. As such, even when supplying a lubricant only to the backup rolls 1*b*, 1*b*, it is possible to supply the lubricant to the work rolls 1*a*, 1*a*.

Figure 5:
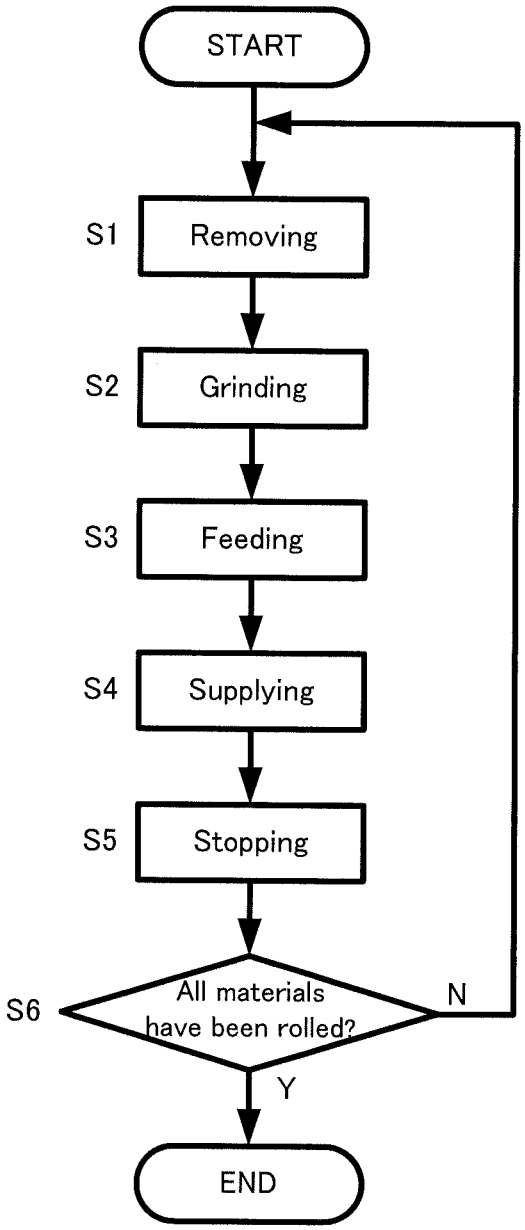
FIG. 5 is a flowchart illustrating a manufacturing method of a hot-rolled steel sheet of the present invention.

FIG. 5 is a flowchart illustrating a manufacturing method of a hot-rolled steel sheet of the present invention (hereinafter simply referred to as a "manufacturing method of the present invention"). The manufacturing method of the present invention will be described below with reference to FIGS. 1 to 5.

As shown in FIG. 5, The manufacturing method of the present invention comprises a removing step (S1), a grinding step (S2), a feeding step (S3), a supplying step (S4), a stopping step (S5), and a judging step (S6). A hot-rolled steel sheet is manufactured through these steps.

The removing step S1 (hereinafter referred to as "S1") is a step of removing at least a part of a lubricant adhered to the work rolls 1*a*, 1*a* and the backup rolls 1*b*, 1*b* by using the lubricant removing device provided with the nozzles 4*a*, 4*a* connected to the headers 4, 4, after completing rolling of a preceding material 5 to be rolled continuously and before starting rolling of a following material 5 to be rolled. More specifically, S1 is a step of removing at least a part of a lubricant adhered to the work rolls 1*a*, 1*a* and the backup rolls 1*b*, 1*b* by outputting an operation command from the control device 8 to the lubricant removing device provided with the nozzles 4*a*, 4*a* connected to the headers 4, 4, and spraying hot water having a temperature of 50° C. or more from the nozzles 4*a*, 4*a* toward the work rolls 1*a*, 1*a* and the backup rolls 1*b*, 1*b* based on the operation command, after completing rolling of a preceding material 5 to be rolled continuously and before starting rolling of a following material 5 to be rolled. After hot water is sprayed from the nozzles 4*a*, 4*a* through S1 and spraying of the hot water is stopped based on the operation command given by the control device 8, the next grinding step S2 will be carried out.

The grinding step S2 (hereinafter referred to as "S2") is a step of grinding the surface of the work rolls 1*a*, 1*a* to control the roll roughness Ra thereof to a target value, after S1 above, by operating the online grinding device 3, 3 based on the operation command outputted from the control device 8. S2 can be a step of controlling the roll roughness Ra of the work rolls 1*a*, 1*a* to a target value, for example by operating the online roll grinding device 3, 3 only for a grinding time of the online roll grinding device 3, 3 determined based on the pre-examined relation between the grinding time of the work roll 1*a* by the online roll grinding device 3, 3 and the roll roughness Ra, only in a case when the temperature unevenness of the preceding rolled material 5 specified in the CPU 8*a* using the detection result given by the temperature sensor 7 is at a predetermined value or more. After the online roll grinding device 3, 3 is operated for a predetermined period of time in S2 and the operation of the online roll grinding device 3, 3 is stopped based on the operation command given from the control device 8, the next feeding step S3 will be carried out.

The feeding step S3 (hereinafter referred to as "S3") is a step of feeding a front end portion of the following material 5 to be rolled through the work rolls 1*a*, 1*a* after S2 above. After the front end portion of the following material 5 to be rolled has been fed in between the work rolls through S3, the next supplying step S4 will be started.

The supplying step S4 (hereinafter referred to as "S4") is a step of supplying a lubricant from the nozzles 2*a*, 2*a* to the work rolls 1*a*, 1*a*, after S3 above, by operating the lubricant supplying device provided with the nozzles 2*a*, 2*a* connected to the headers 2, 2 based on an operation command outputted from the control device 8. In the manufacturing method of the present invention, for example a constant portion of the following material 5 to be rolled is subjected to high load rolling while the lubricant is supplied to the work rolls 1*a*, 1*a*, of the finishing stands 1, 1, 1 disposed on the downstream side.

The stopping step S5 (hereinafter referred to as "S5") is a step of stopping supply of the lubricant from the nozzles 2*a*, 2*a*, after S4 above, specifically by stopping operation of the lubricant supplying device based on an operation command outputted from the control device 8 after completion of rolling of the constant portion of the following material 5 to be rolled.

The judging step S6 (hereinafter referred to as "S6") is step of judging, after S5 above, whether all the materials 5 to be rolled have been rolled or not. If the negative judgment is made in S6, it means that there remains the material 5 that needs to be rolled; therefore, the processing will be returned to S1 above in order to carry out S1 to S5 between bars. By contrast, if the positive judgment is made in S6, it means that there are no materials 5 left that need to be rolled; therefore rolling will be completed.

In this way, the manufacturing method of the present invention comprises S1; therefore it is possible to control the roll roughness Ra of the work rolls 1*a*, 1*a* to a target value by grinding the work rolls using the online roll grinding device 3, 3 in S2. Further, the manufacturing method of the present invention comprises S4 after S2; therefore, surface roughness of the work rolls 1*a*, 1*a* can be inhibited from occurring. Namely, with the configuration comprising S1 to S5, the present invention can provide a manufacturing method of a hot-rolled steel sheet which enables uniform cooling of a rolled material and improvement of the surface properties of the rolled material.

In the manufacturing method of the present invention, in addition to the above steps, it is preferable to rapidly cool the rolled material 5 by using the cooling device 6 immediately after it has been rolled by the final finishing stand 1. In specific, it is preferable to rapidly cool continuously the constant portion of the rolled material 5, at a cooling rate of 600° C./s or more (preferably 1000° C./s or more) within 0.2 seconds after it has been rolled by the final finishing stand 1. Further, in S4 above, it is preferable to carry out, while supplying the lubricant, high load rolling in which a line load is 1.0 t/mm or more (for example, high load rolling in which a line load is 2.0 t/mm or more) in the three downstream-side rolling stands. With this combination, it is possible to manufacture ultrafine-grained steel with little unevenness of the mechanical properties in the sheet width direction.

In the above descriptions of the manufacturing method of the present invention, a configuration comprising the supplying step of supplying the lubricant to the work rolls has been introduced as an example; however, the manufacturing method of the present invention is not limited to this configuration. The manufacturing method of the present invention may comprise a supplying step of supplying a lubricant to the backup rolls instead of the work rolls; or it may comprise a supplying step of supplying a lubricant to the work rolls and the backup rolls. Whichever configuration the supplying step takes, the stopping step may be a step of stopping supply of the lubricant by stopping operation of the lubricant supplying device based on an operation command outputted from the control device, after completion of rolling of the constant portion of the following material to be rolled. Even if the lubricant is supplied to the backup rolls, it is possible to supply the lubricant to the work rolls via the backup rolls supplied with the lubricant. Therefore, the same effects can be attained as in the case of supplying the lubricant to the work rolls.

In the present invention, as for the lubricant to be supplied from the nozzles 2*a*, 2*a*, known lubricants may be adequately employed that are usable for the rolls of a rolling stand provided to a manufacturing apparatus of a hot-rolled steel sheet. For example, a rolling lubricant, a mixture of a rolling lubricant and water, or the like may be used.

Further, in the present invention, the fluid to be supplied from the nozzles 4*a*, 4*a* is not particularly limited as long as it can remove the lubricant. Known fluids may be adequately used. In a case of spraying hot water from the nozzles 4*a*, 4*a*, the temperature of the hot water is preferably 50° C. or more in order to easily improve efficiency of removing the lubricant.

Furthermore, in the present invention, the coolant to be supplied from the nozzles 6*b*, 6*b* is not particularly limited as long as it can decrease the temperature of the rolled material 5. Known coolants such as cooling water exemplified by industrial water may be adequately used. Also, in the present invention, the coolant to be supplied from the nozzles 9*a*, 9*a* is not particularly limited as long as it can decrease the temperature of the work rolls 1*a*, 1*a*. Known coolants such as cooling water exemplified by industrial water may be adequately used.

Additionally, in the present invention, the configurations of the work roll 1*a*, the backup roll 1*b*, the online roll grinding device 3, the temperature sensor 7, and the water draining plate 11 are not particularly limited. Known configurations may be adopted that are applicable to a manufacturing apparatus of a hot-rolled steel sheet. In the present invention, the configuration of the control device 8 is also not particularly limited. Known devices such as a process computer may be employed.

Examples

A steel sheet with a finishing sheet thickness of 2 mm and sheet width of 1000 mm was hot-rolled in a hot finishing mill constituted by seven stands that were F1 to F7 stands. A temperature of the rolled material on the exit side of the rolling mill immediately after rolling and before cooling was set at 850° C. In a case when the rolled material was rapidly cooled after being rolled, a target temperature of cooling the rolled material after rolling it was set at 650° C. Changes were made in the rolling conditions of the F7 stand (whether to use a lubricant or not and whether to carry out cleaning of the rolls with hot water between bars), conditions of online roll grinding, and whether to perform rapid cooling after rolling; and the following were evaluated: roll roughness; occurrence of surface roughness of the steel sheet; temperature unevenness of the rolled material after being water-cooled (a difference between a maximum value and a minimum value of the temperature of the rolled material in an area which is 50 mm away from the edges in the sheet width, after cooling); and the particle size (average particle size) of crystal grains that form the steel sheet. The results are shown in Tables 1 and 2. In Table 2, the online roll grinding is simply written as "grinding" for convenience. In manufacturing a fine grain structure having a particle size of approximately 2 μm, when the temperature unevenness after water cooling exceeds 20° C., the mechanical properties of the steel sheet tend to be non-uniform. Therefore, it is desired to keep the temperature unevenness at 20° C. or less. On the other hand, as described above, with the roll roughness Ra of for example Ra≤0.8 μm, it is possible to uniformly cool the rolled material in the entire sheet width direction. Accordingly, in the case of performing rapid cooling after rolling, when the temperature unevenness of the rolled material was 20° C. or less and the steel sheet had no surface roughness, thereby achieving the object of the present invention, it was evaluated as good (○). In a case of not performing rapid cooling after rolling, when the roll roughness Ra was 0.8 μm or less and the steel sheet had no surface roughness, thereby achieving the object of the present invention, it was evaluated as good (○). Furthermore, when the above conditions evaluated as good (○) were met and also the particle size was 2 μm or less, it was evaluated as excellent (◎), and the results other than these were evaluated as bad (X).

Next, the surface roughness of a hot-rolled steel sheet will be explained. The surface roughness of a hot-rolled steel sheet is caused by the surface roughness of the rolling rolls. It means uneven defects that are generated because an oxidized layer (scales) formed on the surface of the hot-rolled steel sheet is subjected to rolling reduction unevenly. It cannot be judged whether the hot-rolled steel sheet has surface roughness or not in the state when there are scales on the steel sheet surface. The surface roughness is observed after the scales have been removed by acid cleaning. Surface roughness is produced in various forms. For example, it occurs in the entire width of the hot-rolled steel sheet; it occurs in a strip form in one area in the width along the rolling direction; or it occurs discontinuously in an island-like structure. In addition, the forms of the surface roughness vary depending on the degree of the surface roughness. For example, in a case of severe surface roughness, the scales enter a recessed area; and as for mild surface roughness, only skilled examiners can visually identify it.

When a consumer uses the hot-rolled steel sheet with surface roughness after acid cleaning it, the defects of the surface roughness show up after coating or after mild cold pressure, causing an unpleasant appearance. Therefore, it cannot be used as a product. On the other hand, in a case of a structural material which is focused on strength, the surface roughness that is simply a surface defect does not affect performance thereof. Thus, it is usually not considered as a fatal defect. However, the inventors have thought that when it is necessary to uniformly cool the steel sheet in order to ensure uniform mechanical properties after hot rolling, unevenness on the surface hinders uniform cooling and thus the surface roughness causes damage to the structural material as well.

It is seemingly possible to see whether or not there is surface roughness by measuring the roughness of the steel sheet surface. However, it cannot be identified in that way. The reason is that a recessed area of the surface roughness is in a point form like being pricked with a needle, therefore making it extremely difficult to measure the roughness focusing only on that area. Accordingly, identification of the surface roughness in order to see the effects of the present invention was made by acid-cleaning the subject hot-rolled steel sheet, thereafter grinding the entire width of the front and back surfaces thereof with an abrasive paper, a non-woven cloth abrasive (Scotch-Brite), a grind stone for examining steel sheet or the like, and visually confirming it. This method enables even a person not being a skilled examiner to easily see whether or not there is surface roughness. However, as this method leaves marks of the examination and requires time and efforts in the examination, it is usually not used for a hot-rolled steel sheet that is sent out to the market.

TABLE 1

| Test No. | F7 Rolling Reduction [%] | F7 Lubricant | Roll Cleaning with hot water between bars | Online roll grinding | Roll roughness Ra [μm] | Surface roughness | Note |
|---|---|---|---|---|---|---|---|
| 1 | 33 | Yes | Yes | Yes | 0.5 | No | Example of the present invention |
| 2 | 33 | Yes | No | Yes | 1.0 | Yes | Comparative Example |
| 3 | 33 | Yes | No | No | 1.5 | Yes | Comparative Example |
| 4 | 33 | No | No | Yes | 1.5 | Yes | Comparative Example |
| 5 | 33 | No | No | No | 2.5 | Yes | Comparative Example |
| 6 | 25 | Yes | Yes | Yes | 0.6 | No | Example of the present invention |
| 7 | 25 | Yes | No | Yes | 0.9 | Yes | Comparative Example |
| 8 | 25 | Yes | No | No | 1.3 | Yes | Comparative Example |
| 9 | 25 | No | No | Yes | 1.4 | Yes | Comparative Example |
| 10 | 25 | No | No | No | 2.3 | Yes | Comparative Example |

TABLE 2

| Test No. | F7 Rolling Reduction [%] | Linear load [t/mm] | F7 Lubricant | Roll Cleaning with hot water between bars | Grinding | Rapid cooling | Roll roughness Ra [μm] | Temperature uneveness after rapid cooling [° C.] | Surface roughness | Particle diameter [μm] | Evaluation | Note |
|---|---|---|---|---|---|---|---|---|---|---|---|---|
| 1 | 33 | 1.5 | Yes | Yes | Yes | Yes | 0.5 | 10 | No | 1.6 | ◎ | Example of the present invention |
| 2 | 33 | 1.5 | Yes | No | Yes | Yes | 1.0 | 22 | Yes | 1.8 | X | Comparative Example |
| 3 | 33 | 1.5 | Yes | No | No | Yes | 1.5 | 25 | Yes | 2.2 | X | Comparative Example |
| 4 | 33 | 2.1 | No | No | Yes | Yes | 1.5 | 33 | Yes | 1.3 | X | Comparative Example |
| 5 | 33 | 2.1 | No | No | No | Yes | 2.5 | 43 | Yes | 1.4 | X | Comparative Example |
| 6 | 25 | 1.0 | Yes | Yes | Yes | Yes | 0.6 | 10 | No | 1.8 | ◎ | Example of the present invention |
| 7 | 25 | 1.0 | Yes | No | Yes | Yes | 0.9 | 24 | Yes | 1.8 | X | Comparative Example |
| 8 | 25 | 1.0 | Yes | No | No | Yes | 1.3 | 27 | Yes | 2.0 | X | Comparative Example |
| 9 | 25 | 1.4 | No | No | Yes | Yes | 1.4 | 32 | Yes | 1.6 | X | Comparative Example |
| 10 | 25 | 1.4 | No | No | No | Yes | 2.3 | 41 | Yes | 1.7 | X | Comparative Example |
| 11 | 15 | 0.5 | Yes | Yes | Yes | Yes | 0.5 | 13 | No | 3.7 | ○ | Example of the present invention |
| 12 | 15 | 0.7 | No | No | No | Yes | 0.9 | 22 | Yes | 3.4 | X | Comparative Example |
| 13 | 33 | 1.5 | Yes | Yes | Yes | No | 0.6 | — | No | 9.4 | ○ | Example of the present invention |
| 14 | 33 | 1.5 | Yes | No | Yes | No | 1.0 | — | Yes | 9.6 | X | Comparative Example |
| 15 | 33 | 1.5 | Yes | No | No | No | 1.4 | — | Yes | 10.1 | X | Comparative Example |
| 16 | 33 | 2.1 | No | No | Yes | No | 1.6 | — | Yes | 9.0 | X | Comparative Example |
| 17 | 33 | 2.1 | No | No | No | No | 2.7 | — | Yes | 9.1 | X | Comparative Example |
| 18 | 15 | 0.5 | Yes | Yes | Yes | No | 0.5 | — | No | 9.8 | ○ | Example of the present invention |
| 19 | 15 | 0.7 | No | No | No | No | 1.0 | — | Yes | 9.3 | X | Comparative Example |

As shown in Table 1, in Comparative Examples (test Nos. 2-5, and test Nos. 7-10), the roll roughness Ra was 0.9 μm or more, and there was surface roughness on the surface of the steel sheet. In the test Nos. 2 and 7, grinding unevenness was generated due to a lubricant mixed with water, and the rolls could not be ground to a target roll roughness. Further, in the test Nos. 4 and 9, the wear amount was large and it was not possible to grind the rolls to have a target roll roughness by carrying out grinding between bars. By contrast, in Examples of the present invention (test Nos. 1 and 6), the roll roughness Ra after grinding was 0.5 μm or 0.6 μm, and there was no surface roughness on the surface of the steel sheet. That is, according to the present invention, it is possible to grind the work roll surface into a target roll roughness Ra and to inhibit roughness of the work roll surface by a lubricant, therefore enabling uniform cooling of the rolled material and improvement of the surface properties of the cooled material.

In addition, as shown in Table 2, in Comparative Examples (test Nos. 2 to 5, test Nos. 7 to 10, and test No. 12), the temperature unevenness of the rolled material after being water-cooled exceeded 20° C. and the rolled material could not be uniformly cooled. Further, in Comparative Examples (test Nos. 2 to 5, test Nos. 7 to 10, and test No. 12), the roll roughness Ra was 0.9 μm or more and there was surface roughness in the steel sheet. Furthermore, in Comparative Examples (test Nos. 14 to 17, and test No. 19), the roll roughness Ra was 1.0 μm or more and there was surface roughness in the steel sheet. Also in Comparative Examples (test Nos. 3, 12, 14 to 17, and 19) and Examples of the present invention (test Nos. 11, 13, and 18), the average particle size of the crystal grains exceeded 2.0 μm. The reason why the average particle size exceeded 2.0 μm in the test No. 3 was because there was an area of surface roughness (temperature unevenness) in the observed sample, and because the cooling rate in the area of surface roughness was slower than that in the other areas and thus the crystal grain size became large, causing the average value of the crystal grain size to rise. Furthermore, the reason why the average particle size exceeded 2.0 μm in the test Nos. 11 and 12 was that high load rolling in which a line load was 1.0 t/mm or more was not carried out. Also the reason why the average particle size exceeded 2.0 μm in the test Nos. 13 to 19 was because rapid cooling was not performed after the rolling. By contrast, in Examples of the present invention (test Nos. 1 and 6) it was possible to keep at 10° C. the temperature unevenness of the rolled material after being water-cooled; thus, there was no surface roughness in the steel sheet, and the average particle size of the crystal grains was 2.0 μm or less.

That is, according to the present invention, it was possible to uniformly cool the rolled material and to improve the surface properties of the rolled material.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a manufacturing apparatus and a manufacturing method of a hot-rolled steel sheet with such modifications are also encompassed within the technical range of the invention.

INDUSTRIAL APPLICABILITY

The manufacturing apparatus and manufacturing method of a hot-rolled steel sheet of the present invention can be employed in manufacturing a hot-rolled steel sheet such as ultrafine-grained steel to be used for automobiles, household electric appliances, machine structures, building constructions, and other purposes.

DESCRIPTION OF THE SYMBOLS

1 rolling stand
1*a* work roll
1*b* backup roll
2 header (lubricant supplying device)
2*a* nozzle (lubricant supplying device)
3 online roll grinding device
4 header (lubricant removing device)
4*a* nozzle (lubricant removing device)
5 material to be rolled/rolled material
6 cooling device
6*a* header
6*b* nozzle
7 temperature sensor (detecting device)
8 control device
9 header
9*a* nozzle
10, 20 manufacturing apparatus of hot-rolled steel sheet
11 water draining plate

The invention claimed is:

1. A manufacturing apparatus of a hot-rolled steel sheet comprising:

a rolling stand provided with work rolls and backup rolls;

a lubricant supplying device that supplies a lubricant to the work rolls and/or the backup rolls;

an online roll grinding device that grinds a surface of the work rolls; and a lubricant removing device that is configured to remove at least a part of the lubricant adhered to the work rolls, or to the work rolls and the backup rolls, before the surface of the work rolls is ground by the online roll grinding device; and a water-cooling device that cools the work rolls with water;

wherein the lubricant removing device sprays cooling water having a temperature of 50° C. or more, wherein the online roll grinding device is disposed on an upstream side of the work rolls in the traveling direction of a material to be rolled by the rolling stand, and the lubricant removing device is disposed on a downstream side of the work rolls in the traveling direction of the material to be rolled by the rolling stand.

2. The manufacturing apparatus of a hot-rolled steel sheet according to claim 1, further comprising:

two or more rolling stands that are disposed continuously in a traveling direction of a material to be rolled by the rolling stands; and a cooling device that cools the rolled material and that is disposed on a downstream side, in the traveling direction, of the rolling stand disposed on an end on the downstream side in the traveling direction.

3. The manufacturing apparatus of a hot-rolled steel sheet according to claim 2, wherein a line load is 1.0 t/mm or more at least at a time when the material to be rolled is rolled by the rolling stand disposed on the end on the downstream side in the traveling direction.

4. The manufacturing apparatus of a hot-rolled steel sheet according to claim 3, wherein a detecting device that detects temperature unevenness of the material rolled by the rolling stand is disposed on a downstream side of the cooling device in the traveling direction; and a control device is provided that is configured to control operation of the online roll grinding device based on the temperature unevenness detected by the detecting device.

5. The manufacturing apparatus of a hot-rolled steel sheet according to claim 2, further comprising:

a detecting device that detects temperature unevenness of the material rolled by the rolling stand and that is disposed on a downstream side of the cooling device in the traveling direction; and a control device that is configured to control operation of the online roll grinding device based on the temperature unevenness detected by the detecting device.

6. A manufacturing method of a hot-rolled steel sheet that rolls a plurality of materials to be rolled by using a manufacturing apparatus of a hot-rolled steel sheet that comprises: a rolling stand provided with work rolls and backup rolls; a lubricant supplying device that supplies a lubricant to the work rolls and/or the backup rolls; an online roll grinding device that grinds a surface of the work rolls; and a lubricant removing device that is configured to remove at least a part of the lubricant adhered to the work rolls, or to the work rolls and the backup rolls, before the surface of the work rolls is ground by the online roll grinding device, and a water-cooling device that cools the work rolls with water, wherein the online roll grinding device is disposed on an upstream side of the work rolls in the traveling direction of a material to be rolled by the rolling stand, and the lubricant removing device is disposed on a downstream side of the work rolls in the traveling direction of the material to be rolled by the rolling stand, the method comprising:

removing at least a part of the lubricant adhered to the work rolls, or to the work rolls and the backup rolls by using the lubricant removing device after completing rolling of a preceding material to be rolled;

grinding the work rolls by using the online roll grinding device after the removing;

feeding a front end portion of a following material to be rolled through the work rolls after the grinding;

supplying the lubricant to the work rolls and/or the backup rolls from the lubricant supplying device after the feeding;

stopping supply of the lubricant from the lubricant supplying device after the supplying, wherein in the removing step, cooling water having a temperature of 50° C. or more is sprayed from the lubricant removing device.

7. The manufacturing method of a hot-rolled steel sheet according to claim 6, wherein two or more rolling stands are disposed continuously in a traveling direction of a material to be rolled by the rolling stands;

a cooling device that cools the rolled material is disposed on a downstream side, in the traveling direction, of the rolling stand disposed on an end on the downstream side in the traveling direction; and the rolled material is cooled by the cooling device immediately after completion of the rolling by the rolling stand disposed on the end on the downstream side in the traveling direction.

8. The manufacturing method of a hot-rolled steel sheet according to claim 7, wherein a line load is 1.0 t/mm or more at least at a time when the material to be rolled is rolled by the rolling stand disposed on the end on the downstream side in the traveling direction.

9. The manufacturing method of a hot-rolled steel sheet according to claim 8, wherein a detecting device that detects temperature unevenness of the material rolled by the rolling stand is disposed on a downstream side of the cooling device in the traveling direction; and a control device is provided that is configured to control operation of the online roll grinding device based on the temperature unevenness detected by the detecting device.

10. The manufacturing method of a hot-rolled steel sheet according to claim 7, wherein a detecting device that detects temperature unevenness of the material rolled by the rolling stand is disposed on a downstream side of the cooling device in the traveling direction; and a control device is provided that is configured to control operation of the online roll grinding device based on the temperature unevenness detected by the detecting device.

* * * * *